US008851178B2

(12) United States Patent
Lesso et al.

(10) Patent No.: US 8,851,178 B2
(45) Date of Patent: Oct. 7, 2014

(54) SYSTEM AND METHOD FOR FRACTURING WHILE DRILLING

(75) Inventors: William Lesso, Anderson, TX (US); Robert Utter, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 547 days.

(21) Appl. No.: 11/871,239

(22) Filed: Oct. 12, 2007

(65) Prior Publication Data

US 2009/0095474 A1 Apr. 16, 2009

(51) Int. Cl.

| | |
|---|---|
| ***E21B 12/00*** | (2006.01) |
| ***E21B 43/26*** | (2006.01) |
| ***E21B 7/28*** | (2006.01) |
| ***E21B 7/00*** | (2006.01) |

(52) U.S. Cl.

CPC . *E21B 43/26* (2013.01); *E21B 7/28* (2013.01); *E21B 7/00* (2013.01)

USPC ..... 166/308.1; 175/315; 166/177.5; 166/243

(58) Field of Classification Search

None

See application file for complete search history.

(56) References Cited

U.S. PATENT DOCUMENTS

| | | | | |
|---|---|---|---|---|
| 2,688,463 | A * | 9/1954 | Bettes | 175/80 |
| 3,231,031 | A * | 1/1966 | Cleary | 175/67 |
| 3,376,942 | A * | 4/1968 | Van Winkle | 175/81 |
| 3,507,540 | A * | 4/1970 | Silverman | 299/15 |
| 5,180,020 | A | 1/1993 | Fuh et al. | |
| 5,207,282 | A | 5/1993 | Fuh et al. | |
| 6,419,019 | B1 | 7/2002 | Palmer et al. | |
| 7,308,937 | B2 * | 12/2007 | Radford et al. | 166/269 |
| 2004/0250614 | A1 | 12/2004 | Ander | |
| 2005/0230112 | A1 | 10/2005 | Reddy et al. | |
| 2006/0070432 | A1 | 4/2006 | Ander | |
| 2006/0122071 | A1 | 6/2006 | Reddy et al. | |
| 2006/0213662 | A1 | 9/2006 | Creel et al. | |
| 2007/0012447 | A1 | 1/2007 | Fang et al. | |
| 2007/0017676 | A1 | 1/2007 | Reddy et al. | |
| 2007/0017708 | A1 | 1/2007 | Radford | |
| 2007/0169937 | A1 | 7/2007 | Allin et al. | |
| 2007/0173412 | A1 | 7/2007 | Allin et al. | |
| 2007/0209796 | A1 | 9/2007 | Santra et al. | |
| 2007/0284106 | A1 * | 12/2007 | Kalman et al. | 166/298 |
| 2007/0287639 | A1 | 12/2007 | Reddy et al. | |
| 2008/0000640 | A1 | 1/2008 | Santra et al. | |
| 2008/0006404 | A1 | 1/2008 | Reddy et al. | |

OTHER PUBLICATIONS

Mexican Office Action dated Nov. 22, 2011 for corresponding Mexican Application No. MX/a/2008/012987.

* cited by examiner

*Primary Examiner* — Angela M DiTrani

(74) *Attorney, Agent, or Firm* — Rachel E. Greene; Tim Curington

(57) ABSTRACT

A method of fracturing a formation while drilling a wellbore. The method includes providing a bottomhole assembly ("BHA") having a reamer positioned above a pilot hole assembly, connecting the BHA to a drill string, actuating the BHA to drill a first wellbore section with the reamer and to drill a pilot hole with the pilot hole assembly, hydraulically sealing the pilot hole from the first wellbore section, and fracturing the formation proximate the pilot hole.

15 Claims, 1 Drawing Sheet

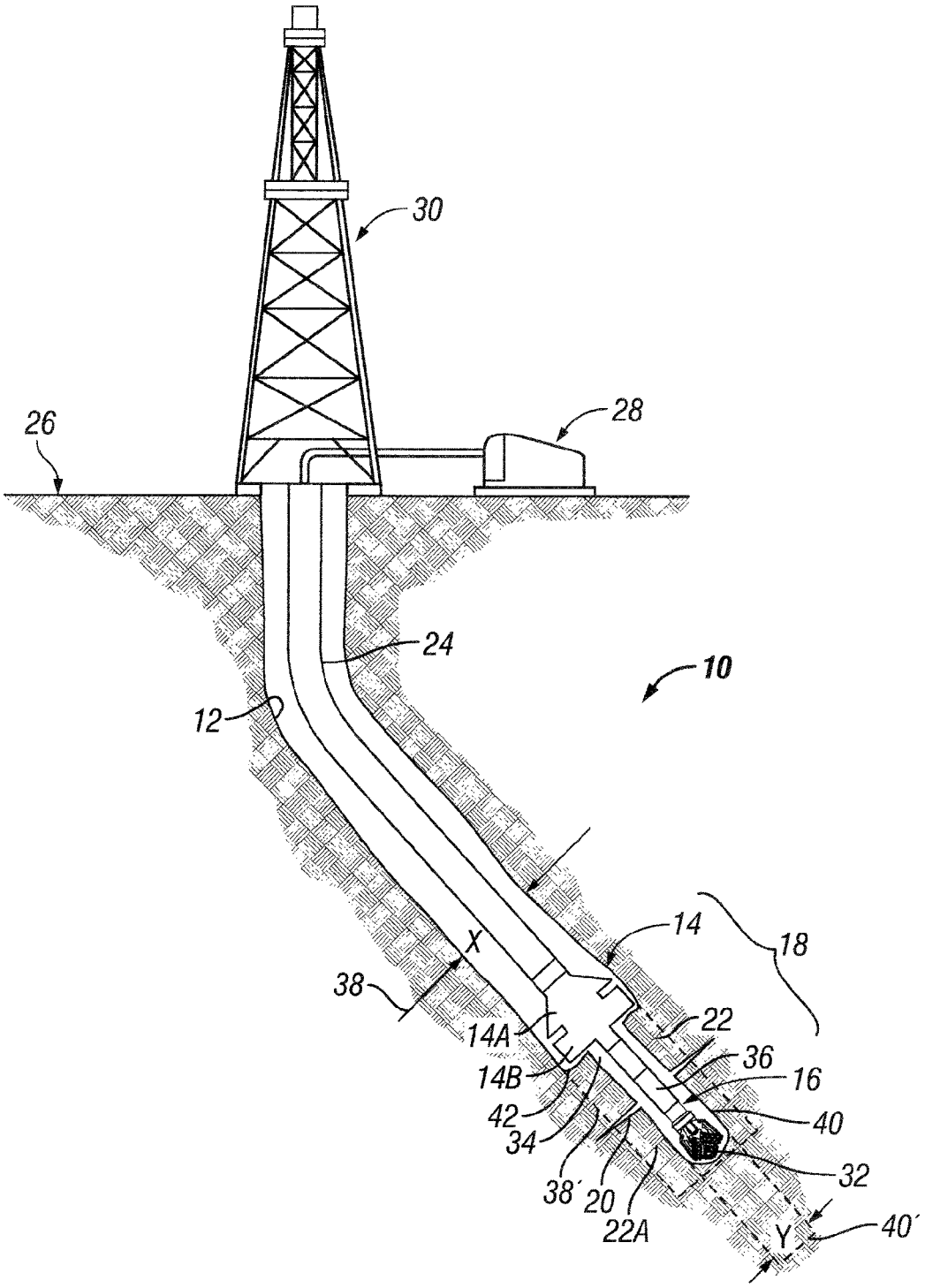
30
28
26
24
10
12
14
18
X
38
22
14A
36
14B
16
42
40
34
32
38´
20
22A
Y
40´

SYSTEM AND METHOD FOR FRACTURING WHILE DRILLING

TECHNICAL FIELD

The present invention relates in general to wellbore operations and more specifically to a method and system for creating fractures in a reservoir formation surrounding a wellbore.

BACKGROUND

The statements in this section merely provide background information related to the present disclosure and may not constitute prior art.

It is often desired to create fractures in the earthen formation surrounding a wellbore to stimulate the productivity and/or injectivity of the formation. It is a desire of the present invention to provide a system and method for selectively placing and creating hydraulic fractures in a reservoir formation. It is a still further desire to provide a system and method for selectively placing and creating hydraulic fractures in a wellbore while drilling the wellbore.

SUMMARY

In view of the foregoing and other considerations, the present invention relates to fracturing subterranean formations via a wellbore and more specifically to fracturing the formation while drilling the wellbore.

Accordingly, a fracturing system, bottomhole assembly and methods for fracturing subterranean formations are provided. One method of fracturing a formation while drilling a wellbore includes the steps of: providing a bottomhole assembly ("BHA") having a reamer positioned above a pilot hole assembly; connecting the BHA to a drill string; actuating the BHA to drill a first wellbore section with the reamer and to drill a pilot hole with the pilot hole assembly; hydraulically sealing the pilot hole from the first wellbore section; and fracturing the formation proximate the pilot hole.

An example of a bottomhole assembly for fracturing a formation proximate a section of a wellbore includes: a drill bit; a reamer positioned above the drill bit and adapted to create a larger diameter wellbore section in the formation than a pilot hole formed in the formation by the drill bit; a by-pass sub positioned between the drill bit and the reamer; and a mechanism for substantially hydraulically sealing the pilot hole formed from the wellbore section formed.

The foregoing has outlined some of the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein:

FIG. 1 is a schematic drawing illustrating a method and system for creating fractures in a reservoir while drilling the wellbore.

DETAILED DESCRIPTION

In the following description, numerous details are set forth to provide an understanding of the present invention. It should be noted that in the development of any such actual embodiment, numerous implementation—specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure, and that numerous variations or modifications from the described embodiments are possible. Further, the description and examples are presented solely for the purpose of illustrating the preferred embodiments of the invention and should not be construed as a limitation to the scope and applicability of the invention.

Refer now to the drawings wherein depicted elements are not necessarily shown to scale and wherein like or similar elements are designated by the same reference numeral through the several views.

As used herein, the terms "up" and "down"; "upper" and "lower"; and other like terms indicating relative positions to a given point or element are utilized to more clearly describe some elements of the embodiments of the invention. Commonly, these terms relate to a reference point as the surface from which drilling operations are initiated as being the top point and the total depth of the well being the lowest point.

FIG. 1 is schematic illustration of a fracturing system of the present invention, generally designated by the numeral 10, being utilized in the drilling of a wellbore 12. System 10 includes a pilot hole assembly 16 and a reamer-sealer 14. Pilot hole assembly 16 and reamer-sealer 14 are connected to one another to form a ("BHA") 18.

BHA 18 is utilized to drill wellbore 12 and to form fractures or channels 20 in the formation 22 surrounding wellbore 12. It is a desire of the present invention to selectively create fractures 20 at the desired location. It is a further desire of the present invention to selectively create fractures 20 while drilling wellbore 12 reducing the expense of multiple trips into the well to fracture multiple zones in the well.

BHA 18 is run into wellbore 12 on a drill string 24. Drill string 24 may include various types of wellbore conveyances including jointed pipe and coiled tubing. In the illustrated example drill string 24 is constructed of jointed pipe. Drill string 24 is functionally connected proximate the surface 26 of the well to a hydraulic system 28 and drilling rig 30. Drilling rig 30 may include various apparatus, such as surface rigs, workover units, coiled tubing units, drilling ships, platforms and the like that are utilized for drilling or working over wells. Hydraulic system 28 may include various elements such as without limitation pumps and fluid reservoirs or tanks for providing a hydraulic fracturing fluid when desired.

Reamer-sealer 14 may include a first drilling device **14*a* and a sealing mechanism 14*b*. First drilling device 14*a* may be a reamer, drill bit or other formation 22 cutting tool. Sealing mechanism 14*b* may be a separate element from reamer 14*a*, incorporated into reamer 14*a*, or may be reamer 14*a* utilized as a sealing mechanism. Reamer-sealer 14 is positioned above pilot hole assembly 16 relative to surface 26 such that first drilling device 14*a* creates a first wellbore section 38 and pilot hole assembly 16 drills or forms pilot hole 40**.

Pilot hole assembly 16 includes a second drilling device 32 and a by-pass sub 34. Second drilling device 32 may be a drill bit or other tool, such as a reamer, adapted to cut or drill a bore into formation 22. Pilot hole assembly 16 may include additional elements general denoted by the numeral 36. Elements 36 may include measurement while drilling (MWD) tools, logging-while-drilling (LWD) tools, a mud motor or other driving mechanism in connection with drill bit 32.

Reamer 14*a* is selected so as to create a larger diameter hole than created by drill bit 32. In operation reamer 14*a* creates first wellbore section 38 having a diameter "X" which is larger than the pilot hole 40 portion of wellbore 12 having a diameter "Y". The departure of pilot hole section 40 from wellbore 38 creates shoulder or upset 42.

In the illustrated example, sealer 14*b* is adapted for creating a hydraulic seal at upset 42 sufficient to fracture formation region 22*a* proximate pilot hole 38. For example, weight may be put down on reamer-sealer 14 via drill string 24 creating the seal at upset 42. Additionally a sealing element, such as an inflatable device may be utilized to effect the desired seal. It may further be desired to provide the seal proximate upset 42 and between BHA 18 and wellbore 12 or drill string 24 and wellbore 12, for example with an expandable or inflatable packer or the like.

Examples of the operation of fracturing system 10 of the present invention are now described. A method of fracturing a formation 22 surrounding the wellbore 12 includes the steps of operating a bottomhole assembly 18 to drill a first wellbore section 38 and a pilot hole 40; hydraulically sealing the pilot hole proximate to BHA 18; and creating fractures 20 in the formation 22*a* proximate to pilot hole 40. Fracturing formation 22*a* may be accomplished by pumping fluid through drill string 24, out of by-pass sub 34 into hydraulically sealed pilot hole 40 overcoming the fracture pressure of formation 22*a* creating channels 20.

After fracturing formation 22*a*, the hydraulic seal may be released and then BHA 18 may be actuated or operated, such as by rotation of drill string 24 and/or activation of a mud motor 36 to expand or drill pilot hole 40 out to the diameter of first wellbore section 38 and substantially simultaneously drilling a subsequent pilot hole 40'. The expanded diameter of pilot hole 40 is indicated by the dashed line designated 38'. The subsequent pilot hole is designated by the numeral 40' indicated by the dashed lines.

An example of a BHA 18 of the present invention for fracturing a formation penetrated by a wellbore includes a drill bit 32, a reamer 14*a*, a by-pass sub 34, and a mechanism 14*b* for substantially hydraulically sealing a portion of the wellbore. Reamer 14*a* may be positioned above drill bit 32 and adapted to created a wellbore section 38 having a larger diameter than a pilot hole 40 formed in formation 22 by drill bit 32.

From the foregoing detailed description of specific embodiments of the invention, it should be apparent that a system for creating fractures in formations while drilling the wellbore that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A method of fracturing a subterranean formation surrounding a wellbore, the method comprising:

operating a bottomhole assembly ("BHA") comprising a first drilling device positioned above a second drilling device to drill a first wellbore section without creating fractures, and a by-pass sub positioned between the first drilling device and the second drilling device;

operating the BHA to drill a pilot hole with the second drilling device at a selected location proximate to a reservoir;

hydraulically sealing the pilot hole by sealing against an upset feature formed between the pilot hole and a larger diameter wellbore section formed by the first drilling device to drill the first wellbore section; and pumping hydraulic fracturing fluid through the by-pass sub to create fractures in the subterranean formation surrounding the wellbore.

2. The method of claim 1, further including:

releasing the hydraulic sealing after creating the fractures;

drilling the pilot hole with the BHA to a diameter of the larger diameter wellbore section;

operating the BHA and drilling a subsequent pilot hole at a subsequent selected location proximate with a reservoir;

hydraulically sealing the subsequent pilot hole by sealing against a subsequent upset feature formed between the subsequent pilot hole and the larger diameter wellbore section; and hydraulic fracturing to create fractures in the formation that are communicable with the reservoir at the subsequent selected location.

3. The method of claim 1, wherein the first drilling device is a reamer and the second drilling device is a drill bit.

4. The method of claim 1, wherein said sealing occurs prior to the hydraulic fracturing.

5. The method of claim 1, further comprising an inflatable packer for sealing.

6. The method of claim 1, further comprising connecting the BHA to a string of drill pipe.

7. The method of claim 1, further comprising connecting the BHA to a string of coiled tubing.

8. A method of fracturing a subterranean formation while drilling a wellbore, the method comprising:

providing a bottomhole assembly ("BHA") having a reamer positioned above a pilot hole assembly, wherein the pilot hole assembly comprises a drill bit;

connecting the BHA to a pipe string;

actuating the BHA to drill a larger diameter wellbore section with the reamer and to drill a similarly directed pilot hole with the pilot hole assembly to a selected location without creating fractures;

hydraulically sealing the pilot hole from the larger diameter wellbore section by setting the reamer down on an upset feature formed between the larger diameter wellbore section and the pilot hole; and hydraulic fracturing the formation surrounding the wellbore between the reamer and the drill bit.

9. The method of claim 8, wherein the step of hydraulic fracturing includes pumping a fluid through the drill string and out the pilot hole assembly in a direction transverse to the pilot hole.

10. The method of claim 8, further including:

releasing the seal of the pilot hole after fracturing the pilot hole;

operating the BHA to drill the pilot hole with the reamer to a diameter of the larger diameter wellbore section;

operating the BHA to drill a subsequent pilot hole with the pilot hole assembly at a subsequent selected location without creating fractures;

hydraulically sealing the subsequent pilot hole by setting the reamer down on a subsequent upset feature formed between the subsequent pilot hole and the larger diameter wellbore section; and hydraulic fracturing the formation beyond the wellbore at the subsequent location between the reamer and the drill bit.

11. The method of claim 8, wherein the reamer includes an inflatable packer for hydraulically sealing the pilot hole section from the larger diameter wellbore section.

12. The method of claim 8, wherein the pilot hole assembly further includes a by-pass sub.

13. The method of claim 8, wherein the pipe string comprises drill pipe.

14. The method of claim 8, wherein the pipe string comprises coiled tubing.

15. A method of hydraulically fracturing a subterranean formation to stimulate a reservoir surrounding a wellbore comprising:

operating a bottomhole assembly ("BHA") comprising a first drilling device positioned above a second drilling device to drill a large diameter wellbore section and a pilot hole, and a by-pass sub positioned between the first drilling device and the second drilling device;

hydraulically sealing the pilot hole by sealing against a feature formed between an outer circumference of the pilot hole and an outer circumference of the large diameter wellbore section; and pumping hydraulic fracturing fluid through the by-pass sub and hydraulically fracturing the pilot hole to create fractures in the formation that surrounds the wellbore to communicate with the reservoir.

* * * * *